United States Patent [19]

Furuminato

[11] 4,370,827

[45] Feb. 1, 1983

[54] WEATHERTIGHT DOOR ASSEMBLY

[75] Inventor: Kozo Furuminato, Kurobe, Japan

[73] Assignee: Yoshida Kogyo K K, Tokyo, Japan

[21] Appl. No.: 174,713

[22] Filed: Aug. 1, 1980

[30] Foreign Application Priority Data

Aug. 10, 1979 [JP] Japan ..... 54-109457

[51] Int. Cl.[3] ..... E06B 7/16

[52] U.S. Cl. ..... 49/368; 49/485

[58] Field of Search ..... 49/367, 368, 369, 485

[56] References Cited

U.S. PATENT DOCUMENTS

| | | | |
|---|---|---|---|
| 1,726,186 | 8/1929 | Lane | 49/368 |
| 3,649,060 | 3/1972 | Ruff | 49/368 X |
| 4,057,170 | 11/1977 | Dougherty | 49/368 X |
| 4,058,332 | 11/1977 | DiFazio | 49/368 X |

*Primary Examiner*—Kenneth Downey

*Attorney, Agent, or Firm*—Bucknam and Archer

[57] ABSTRACT

A weathertight door assembly having a first sealing means on an outer frame for sealing the gaps between the outer frame and the periphery of a pair of doors when the latter is closed, and a pair of coacting second and third sealing means on one of the doors for sealing the gap between inner vertical frame members of the doors when the latter are closed. A projection extends on and along one of the inner vertical frame members for covering the gap between the doors when the latter are closed. The second sealing means is supported on the projection and coextends with the length therewith. The third sealing means is supported on the said one inner vertical frame member and coextends with the length thereof. As the doors are closed, the third sealing means is sandwiched partly between the second sealing means and the other inner vertical frame member and partly between the latter and the first sealing means.

4 Claims, 5 Drawing Figures

WEATHERTIGHT DOOR ASSEMBLY

BACKGROUND OF THE INVENTION

1. Field of the Invention

The present invention relates generally to doors, and more particularly to improvements in weatherproofing for a double wing door assembly or a pair of adjacent doors pivotably supported on respective side jambs.

2. Prior Art

Attempts have been made to weathertightly seal the gaps between an outer frame defining a door opening and a pair of adjacent doors pivotably supported on side jambs of the outer frame. To this end, it has been a common practice to provide one of the doors with a projection extending along an inner vertical frame member thereof for covering the gap between the doors, the projection carrying weathertight sealing means which is engageable with the other door on an inner vertical frame member thereof when the doors are closed. However, the projection has a pair of cut-aways one at each vertical end in order to allow the header and sill of the outer frame to come into contact with the periphery of the two doors completely when the latter are closed, the cut-aways in the projection being devoid of the weathertight seal means. With this arrangement only insufficient weather-proofing can be achieved.

A solution has been proposed by Japanese Utility Model Publication No. 53-14527. According to the Japanese Publication the cut-aways in the projection are sealed by a pair of sealing blocks, respectively, which are engageable with both the inner vertical frame members to the doors on their opposite ends when the doors are closed. However, the sealing blocks are hard to deform and hence can come in contact with both the inner vertical frame members only when the doors are closed in alignment with one another. This requires that the weathertight door assembly should be assembled with high dimensional accuracy.

SUMMARY OF THE INVENTION

It is therefore an object of the present invention to provide a weathertight door assembly with which sufficient weatherproofing can be achieved even if the doors are not absolutely in alignment with one another as they are closed.

Another object of the invention is to provide a weathertight door assembly which can be assembled without high dimensional accuracy.

According to the present invention, a weathertight door assembly includes a first sealing means supported on an outer frame along door-opening-defining inside edges thereof for sealing gaps between the outer frame and the peripheries of a pair of doors when the latter are closed, and a pair of coacting second and third sealing means on one of the doors for sealing a gap between inner vertical frame members of the doors when the latter are closed, one of the inner vertical frame members having a projection extending therealong for covering the gap between the inner vertical frame members. The second sealing means is supported on the projection cut away at each end and coextends with the length thereof. The third sealing means is supported on the said one inner vertical frame member and coextends with the length thereof. The third sealing means, when the doors are closed, is sandwiched partly between the second sealing means and the other inner vertical frame member and partly between the latter and the first sealing means.

Many other advantages, features and additional objects of the present invention will become manifest to those versed in the art upon making reference to the detailed description and the accompanying drawings in which preferred embodiments incorporating the principles of the present invention are shown by way of illustrative example.

DETAILED DESCRIPTION OF THE PREFERRED EMBODIMENTS

Figure 1:
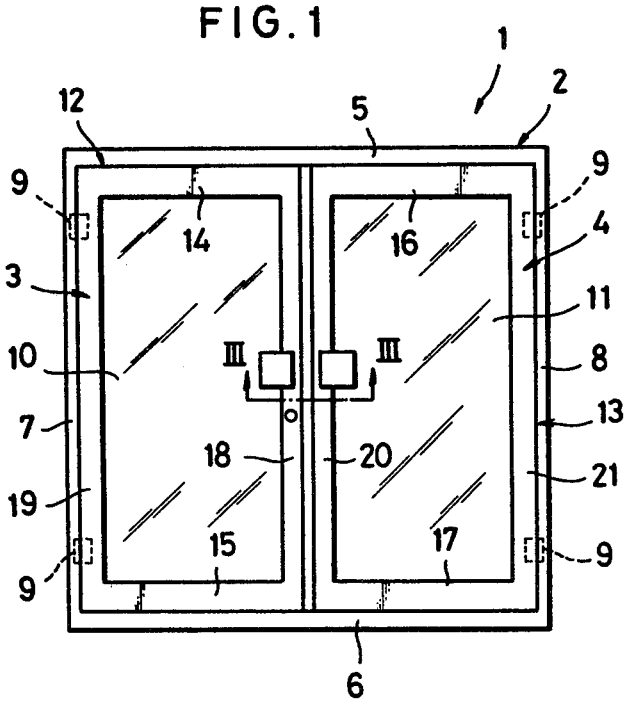
FIG. 1 is a front view of a weathertight door assembly embodying the present invention.

The principles of the present invention are particularly useful when embodied in a weathertight door assembly such as shown in FIG. 1, generally indicated by the numeral 1. The door assembly 1 comprises an outer frame 2 adapted to be mounted within an opening in a building wall (not shown) and defining a door opening, and a pair of doors 3, 4 hung on the outer frame 1 for jointly closing the door opening.

The outer frame 2 includes a header 5, a sill 6, and a pair of side jambs 7, 8 connected to the header 5 and sill 6 at their ends. The doors 3, 4 are pivotably supported on the side jambs 7, 8, respectively, by means of hinges 9. Each of the doors 3, 4 includes a panel or pane 10, 11 and an inner frame 12, 13 extending along and embracing the periphery of the panel 10, 11. Each inner frame 12, 13 includes a pair of upper and lower horizontal frame members 14, 15; 16, 17 and a pair of inner and outer vertical frame members 18, 19; 20, 21. One (20) of such two inner vertical frame members 18, 20 has a projection 22 (FIGS. 2, 3 and 4) extending along its interior edge for covering a gap between the inner vertical frame members 18, 20 when the doors 3, 4 are closed.

Figure 2:
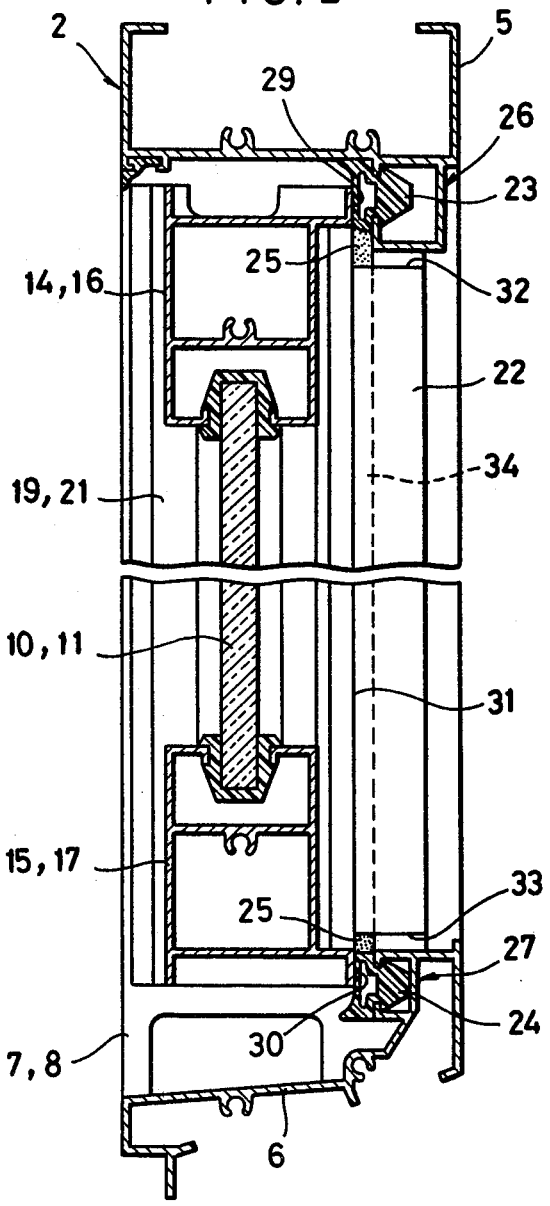
FIG. 2 is an enlarged vertical cross-sectional view of the door assembly shown in FIG. 1.
Figure 3:
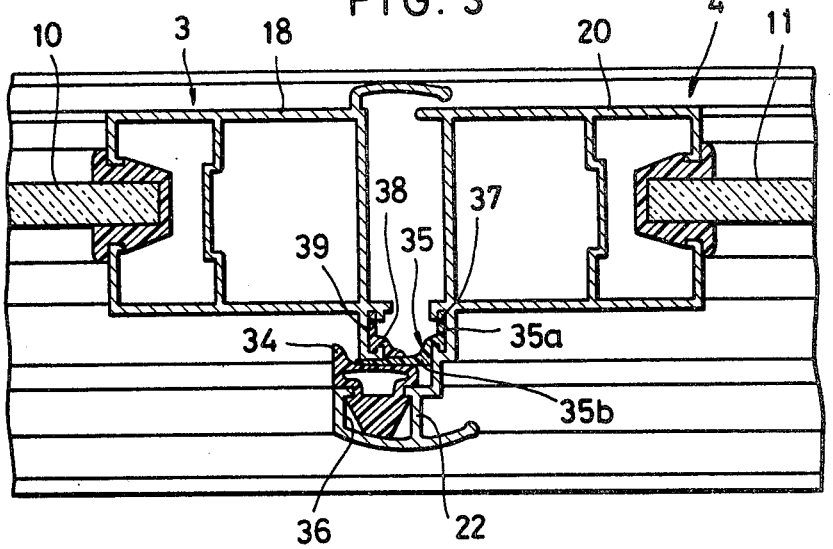
FIG. 3 is an enlarged cross-sectional view taken along line III—III of FIG. 1.
Figure 4:
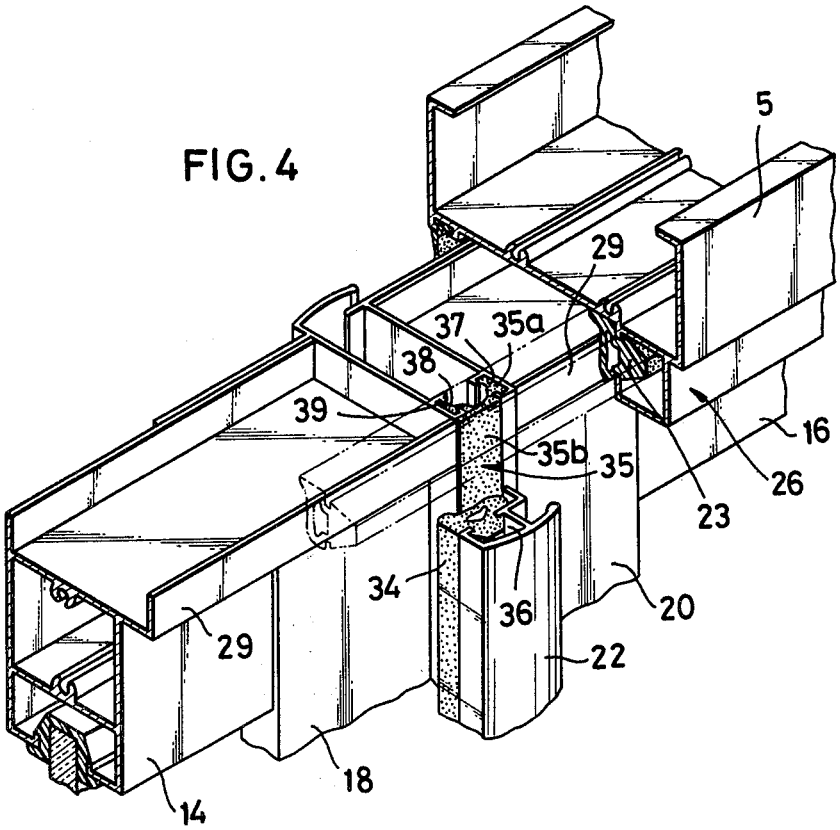
FIG. 4 is an enlarged fragmentary perspective view of the weathertight door assembly of FIG. 1.

As shown in FIG. 2, first sealing means are supported on the outer frame 2 and extend along the door-opening-defining inside edges thereof for sealing the gaps between the outer frame 2 and the periphery of the pair of doors 3, 4 when the latter is closed. The first sealing means include a pair of upper and lower horizontal sealing members 23, 24 and a pair of vertical sealing members 25, 25 (only one shown), all of which are made of a flexible and resilient material such as rubber or soft vinyl chloride. The upper and lower horizontal sealing members 23, 24 are carried by a pair of retaining means 26, 27 on the header and sill 5, 6, respectively. The vertical sealing members 25, 25 are carried by a pair of retainer means (not shown) on the side jambs 7, 8, respectively. The upper horizontal sealing member 23 is engageable with both of the upper horizontal frame members 14, 16 on their interior surfaces 29 when the doors 3, 4 are closed (FIGS. 2 and 4). Similarly, the lower horizontal sealing member 24 is engageable with both of the lower horizontal frame members 15, 17 on their interior surfaces 30. The vertical sealing members 25, 25 are engageable with the outer vertical frame members 19, 21 on their respective interior surfaces 31.

Thus, the gaps between the outer frame 2 and the periphery of the doors 3, 4 are weathertightly sealed as the doors 3, 4 are closed.

The projection 22 of the inner vertical frame member 20 has a pair of cut-aways 32, 33 (FIG. 2) one at each vertical end so that the projection 22 is kept out of interference with the header 5 and the sill 6, and the upper and lower horizontal sealing members 23, 24 are allowed to come into contact with the upper and lower horizontal frame members 14, 16; 15, 17 completely as the doors 3, 4 are closed.

In order to seal the gap between the inner vertical frame members 18, 20 when the doors 3, 4 are closed, a pair of coacting second and third sealing means 34, 35 (FIGS. 3 and 4) is supported on one of the doors (4). The second sealing means 34 is retained by a longitudinally extending groove 36 of the projection 22 and coextends with the length thereof. The third sealing means 35 is retained by a longitudinally extending groove 37 of the inner vertical frame member 20 and coextends with the length thereof, the groove 37 extending along an interior edge of the inner vertical frame member 20. The third sealing means 35 is a flexible and resilient strip having a base portion 35*a* received in the groove 37 and a thin flipper-like portion 35*b*. Accordingly, as the doors 3, 4 are closed, the flipper-like portion 35*b* of the third sealing means is sandwiched partly between the second sealing means 34 and the inner vertical frame member 18 and partly between the latter and the first sealing means (the upper and lower horizontal sealing members 23, 24).

Figure 5:
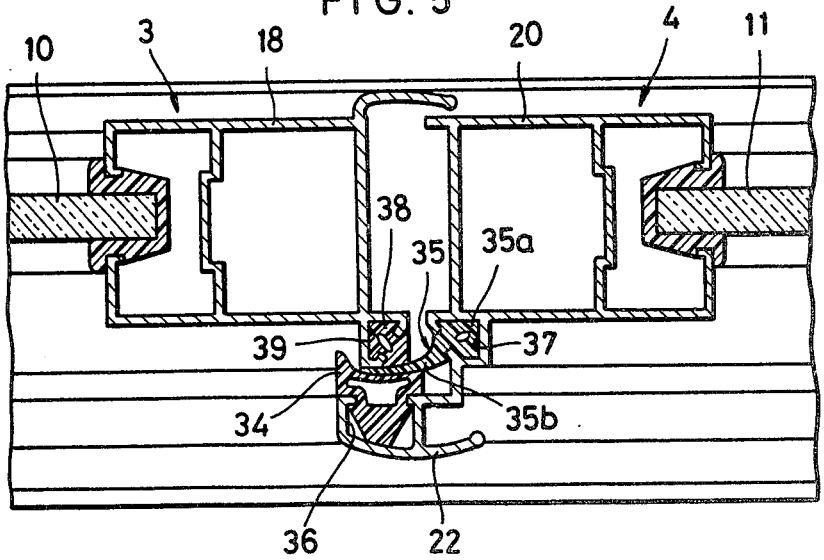
FIG. 5 is a view similar to FIG. 3, but showing a modified weathertight door assembly.

A fourth sealing means 38 (FIGS. 3 and 4) is supported on the other door 3 and is engageable with the flipper-like portion 35*b* of the third sealing means 35. The fourth sealing means 38 is coextensive in length with and retained by a longitudinal extending groove 39 of the inner vertical frame member 18, the groove 39 extending along an interior edge of the inner vertical frame member 18. The grooves 37, 39 are disposed so as to open toward one another as the doors 3, 4 are closed. Alternatively, the grooves 37, 39 may be disposed so as to open obliquely with respect to one another, as shown in FIG. 5.

With the weathertight door assembly thus constructed, reliable weatherproofing can be achieved even if the doors 3, 4 are not absolutely in alignment with one another when they are closed, requiring no high dimensional accuracy in either assembling or installation of the door assembly.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A weathertight door assembly comprising:

(a) an outer frame adapted to be mounted within an opening in a building wall, said outer frame including a header, a sill, and a pair of side jambs connected to said header and sill at their ends to define a door opening;

(b) a pair of doors pivotably supported on said pair of side jambs, respectively, for jointly closing said door opening, each of said doors including a panel and an inner frame extending along and embracing the periphery of said panel, said inner frame including a pair of upper and lower horizontal frame members and a pair of inner and outer vertical frame members, one of such two inner vertical frame members having a projection extending therealong for covering a gap between said inner vertical frame members when said doors are closed, said projection having a pair of cut-aways one at each vertical end;

(c) first sealing means supported on said outer frame along such door-opening-defining inside edges thereof for sealing gaps between said outer frame and the periphery of said pair of doors when the latter is closed, said first sealing means being permitted by said cut-aways of said projections to come into contact with the periphery of said pair of doors when the latter is closed; and (d) a pair of coacting second and third sealing means on one of said doors for sealing a gap between said inner vertical frame members when said doors are closed, said second sealing means being supported on said projection of said one inner vertical frame member and coextending with the length of said projection, said third sealing means being supported on said one inner vertical frame member and coextending with the length thereof, said third sealing means, when said doors are closed, being sandwiched partly between said second sealing means and the other inner vertical frame member and partly between the latter and said first sealing means.

2. A weathertight door assembly according to claim 1, including fourth sealing means supported on the other inner vertical frame member and coextending with the length thereof, said fourth sealing means being engageable with said third sealing means when said doors are closed.

3. A weathertight door assembly according to claim 1, said one inner vertical frame member having a groove extending longitudinally thereof, said groove retaining said third sealing means.

4. A weathertight door assembly according to claim 3, said third sealing means including a flexible and resilient strip having a base portion received in said groove and a flipper-like portion engageable with the other inner vertical frame member when said doors are closed.

* * * * *